US006736496B2

(12) United States Patent
Hanaoka et al.

(10) Patent No.: US 6,736,496 B2
(45) Date of Patent: May 18, 2004

(54) INK TANK AND INK-JET PRINTER USING THE SAME

(75) Inventors: Yukihiro Hanaoka, Nagano (JP); Koji Yamada, Nagano (JP); Manabu Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/134,647

(22) Filed: Apr. 30, 2002

(65) Prior Publication Data

US 2002/0171720 A1 Nov. 21, 2002

(30) Foreign Application Priority Data

May 1, 2001 (JP) ..... P2001-134281
Nov. 14, 2001 (JP) ..... P2001-349106

(51) Int. Cl.[7] ..... B41J 2/175; B41J 2/195
(52) U.S. Cl. ..... 347/86; 347/7
(58) Field of Search ..... 347/7, 86, 87; 141/18; 250/573

(56) References Cited

U.S. PATENT DOCUMENTS 5,616,929 A * 4/1997 Hara ..... 250/573
5,886,721 A 3/1999 Fujii et al.
6,042,224 A 3/2000 Oda et al.
6,209,980 B1 * 4/2001 Kobayashi et al. ..... 347/7
6,332,481 B1 * 12/2001 Shinada et al. ..... 141/18

FOREIGN PATENT DOCUMENTS

| | | |
|---|---|---|
| EP | 0 779 156 A1 | 6/1997 |
| EP | 0 860 284 A2 | 8/1998 |
| EP | 0 869 006 | 10/1998 |
| EP | 0 930 169 | 7/1999 |
| EP | 0 997 294 A2 | 5/2000 |
| EP | 1 147 902 A1 | 10/2001 |
| GB | 2 326 378 | 12/1998 |
| JP | 8-197743 | 8/1996 |
| JP | 8-207298 | 8/1996 |
| JP | 11-115200 | 4/1999 |

OTHER PUBLICATIONS

Patent Abstract of Japan, vol. 016, No. 122 (M–1226), Mar. 27, 1992 and JP 03 288653 A (Seiko Epson Corp.).
Patent Abstract of Japan, vol. 2003, No. 02, Feb. 5, 2003 and JP 2002 283588 A (Ricoh Co. Ltd.).
Patent Abstract of Japan, vol. 009, No. 245 (M–418), Oct. 2, 1985 and JP 60 097858 A (Canon KK).
Patent Abstract of Japan, vol. 2002, No. 09, Sep. 4, 2002 and JP 2002 127454 A (Canon Inc.).
Patent Abstract of Japan, vol. 013, No. 022 (M–786), Jan. 19, 1989 and JP 63 231943 A (Canon Inc.).
Patent Abstract of Japan, vol. 2000, No. 07, Sep. 29, 2000 and JP 2000 108373 A (Copyer Co. Ltd.).
Patent Abstract of Japan, vol. 011, No. 388 (M–652), Dec. 18, 1987 and JP 62 156963 A (Canon Inc.).

* cited by examiner

*Primary Examiner*—Anh T. N. Vo
(74) *Attorney, Agent, or Firm*—Nixon & Vanderhye P.C.

(57) ABSTRACT

A printer and an ink tank for the printer capable of precisely detecting that ink has run out in a foam type ink tank. The ink chamber and an ink passage are formed in this order between the foam containing portion and the ink outlet of a foam-type ink tank. A first filter is installed between the foam containing portion and the ink passage and used to pass bubbles therethrough, whereas a second filter having a pore diameter smaller than the pore diameter of the first filter is installed between the ink chamber and the ink passage. A rectangular prism for detecting an ink end is formed on the side of the ink chamber. When the reflective surface of the rectangular prism is exposed from an ink liquid level as bubbles are gathered in the ink chamber with ink that is running short, light is reflected from the reflective surfaces and is detected by a reflection type optical sensor on the ink-jet printer side, so that the ink end can be determined. In a case where the capacity of the ink chamber is set sufficiently smaller, the ink end is detectable at a point of time when the ink has substantially run out.

18 Claims, 11 Drawing Sheets

INK TANK AND INK-JET PRINTER USING THE SAME

BACKGROUND OF THE INVENTION

1. Field of the Invention

The present invention relates to an ink-jet printer and an ink tank for use in the inkjet printer, wherein the ink tank includes a foam for absorbing and holding ink.

2. Related Art

There is a related art foam-type ink tank used for an ink-jet printer. The foam-type ink tank has a foam containing portion for containing a foam which is used for absorbing and holding ink, an ink outlet that communicates with the foam containing portion, and ports communicating with the atmosphere for opening the foam containing portion into the atmosphere. When ink is sucked under the discharge pressure of an ink-jet head, air corresponding to the sucked amount of ink is caused to flow into the foam containing portion.

In the case of such a foam-type ink tank, a mechanism for detecting the presence or absence of ink in the ink tank in which ink is directly stored, for example, an optical sensor utilizing a prism reflective surface that returns light to the original reflective surface in the absence of ink, or a detection mechanism using a sensor utilizing a change in impedance originating from the presence or absence of ink across a pair of electrodes cannot be directly used to detect the presence or absence of ink.

Consequently, an ink end has heretofore been detected as the result of calculation of the used amount of ink according to the number of dots of ink discharged from the ink-jet head and the sucked amount of ink by an ink pump for sucking ink from the ink-jet head.

Incidentally, a condition in which ink in the ink tank has almost run out is generally called a 'real end' and a condition in which the remaining ink in the ink tank has decreased to a predetermined amount or smaller is also generally called a 'near end.' However, the 'ink end' used in this specification includes both of these conditions unless otherwise specified.

The method of detecting the ink end by detecting the running-out of ink by calculating the used amount of ink and the like has the following problems. Since the discharged amount of ink from the ink-jet head and the sucked amount of ink by means of the ink pump undergo wide variation, the used amount of ink that has been calculated according to these quantities also shows a variation far greater than that of the amount of ink actually used. Therefore, a great margin is usually set in order to settle the ink end. Consequently, a greater amount of ink may be left at a point of time when the ink end is detected, whereby ink may often be wasted.

SUMMARY OF THE INVENTION

It is therefore an object of the invention made in view of the foregoing problems to propose a foam-type ink tank wherein an ink end is made detectable precisely at a point of time substantially where no remaining ink exists therein.

Further, it is an object of the invention to propose an ink-jet printer having an ink-end detecting mechanism for detecting an ink end in such a novel foam-type ink tank.

In order to solve the foregoing problems, an ink tank according to the invention comprises: a foam for absorbing and holding ink; a foam containing chamber for containing the foam; a vent port communicating with the foam containing chamber, the vent port allowing atmospheric air to enter the foam containing chambers; an ink outlet for taking out ink from the foam containing chamber; and an ink chamber for detecting a remaining amount of ink, the ink chamber being disposed between the foam containing chamber and the ink outlet, the ink chamber operable to receive ink and bubbles from the foam containing chamber and supply only the ink to the ink outlet while preventing the bubbles from entering to the ink outlet.

According to the invention, the ink chamber is formed between the foam containing chamber and the ink outlet and when the remaining amount of ink in the foam containing chamber is running short, bubbles are allowed to enter the ink chamber from the foam containing chamber each time ink is supplied from the ink outlet. When the ink in the foam containing chamber runs out, the remaining amount of ink in the ink tank substantially becomes equal to the amount of ink left in the ink chamber. Therefore, an ink end can precisely be detected at a point of time where the remaining amount of ink substantially runs out by detecting the ink end in the ink tank according to the remaining amount of ink in the ink chamber while at the same time, the capacity of the ink chamber is made sufficiently small.

Although the above condition may be regarded as a real end so as to quickly halt the printing process, the printing process may continue by treating that condition as a near end as follows. That is, an amount of ink to be used thereafter is calculated after the ink end (near end) is detected when the condition is regarded as the near end and the real end can be decided when the calculated value reaches an amount equivalent to the capacity of the ink chamber. Even in this case, as only ink liquid is detected in the ink chamber, the remaining amount of ink is precisely detectable and the used amount of ink up to the real end is also calculable, so that waste of ink is reduced.

The ink tank has a projected portion projecting from a bottom wall of the ink chamber; and a communicating port formed at a front end of the projected portion, the communicating port communicating with the ink outlet.

In this case, as the ink outlet can be disposed near the base of the ink chamber, it is possible to make the ink tank compact, while an increase in its height is restrained.

To ensure that useless bubbles are retarded from entering the ink chamber and the ink passage, it is preferable to provide a first filter dividing the foam containing chamber and the ink chamber, the first filter formed of a first porous material which allows bubbles in the foam containing chamber to pass therethrough by an ink suction force acting on the ink outlet, and a second filter provided on the communicating port, the second filter formed of a second porous material having a pore diameter smaller than the pore diameter of the first porous material.

In this case, in order to supply the ink gathered in a position lower than the position in which the second filter is mounted in the ink chamber, the second filter is formed with an absorbing material portion for sucking up ink, the absorbing material portion being extended to the bottom wall of the ink chamber.

An absorbing material for sucking up ink may be disposed as another member different from the second filter, the absorbing material being extended from the communicating port to the bottom wall of the ink chamber.

A prism is preferably provided on one of walls of the ink chamber, wherein the prism reflects light received at the prism when the ink fails to contact the prism, and refracts the light into the ink chamber when the ink contacts the prism.

The remaining amount of ink is made detectable by forming two interface surfaces, each disposed facing at an oblique angle to one another, and each extending from the vicinity of a bottom wall of the ink chamber to the vicinity of an upper wall of the ink chamber. In this case, the setting of the value of the remaining amount of ink is made freely variable by making variable the optical sensor position for detecting the prism.

An ink tank according to the invention comprises: a foam for absorbing and holding ink; a foam containing chamber for containing the foam; a vent port communicating with the foam containing chamber, the vent port allowing atmospheric air to enter the foam containing chamber; an ink outlet for taking out ink from the foam containing chamber; an ink chamber for detecting the remaining amount of ink, the ink chamber being disposed between the foam containing chamber and the ink outlet, the ink chamber operable to receive ink and bubbles from the foam containing chamber and supply only the ink to the ink outlet while preventing the bubbles from entering to the ink outlet; a projected portion projecting from a bottom wall of the ink chamber; a communicating port formed at a front end of the projected portion, the communicating port communicating with the ink outlet; and a cap member for covering the projected portion, wherein a gap for sucking up ink is formed between the projected portion and the cap member, the gap being extended from the communicating port to the bottom wall of the ink chamber.

When the ink absorbing material portion and the ink absorbing material are employed, as ink is sucked up by their capillary action, although there is an upper limit to an amount of ink to be sucked up. When the used amount of ink is large, for example, it is feared that the amount of ink sucked up by the capillary action may fail to catch up with what is actually required. In a case where the gap for sucking up ink is formed by using the cap member, a greater amount of ink can be sucked up in comparison with a case where the ink absorbing member or the ink absorbing material is employed by properly setting the width of the gap.

In order that useless bubbles are retarded from entering the ink chamber and the ink passage, it is preferable to provide the first filter dividing the foam containing chamber and the ink chamber, the first filter formed of a first porous material which allows bubbles in the foam containing chamber to pass therethrough by ink suction force acting on the ink outlet; and the second filter provided on the communicating port, the second filter formed of a second porous material having a pore diameter smaller than the pore diameter of the first porous material.

Provision of a projection for use in forming the gap for sucking up ink on the outer face of the projected portion and/or the inner face of the cap member makes formable a gap having proper width only by mounting the cap member.

The projection is preferably made to function as a projection for positioning the cap member with respect to the projected portion.

The cap member is such that a communicating section which communicates with the gap for sucking up ink is formed between an open edge face of the cap and the bottom wall of the ink chamber facing the open edge face thereof.

The open edge face of the cap preferably has a plurality of projections for use in forming the communicating portion, whereby the communicating portion is automatically formed when the cap is mounted on the projected portion.

In order to detect the amount of ink in the ink chamber according to the invention, it is desirable to provide a prism on one of walls of the ink chamber, wherein the prism reflects light received at the prism when the ink fails to contact the prism, and refracts the light into the ink chamber when the ink contacts the prism. Moreover, the remaining amount of ink is made detectable by forming the reflective surfaces of the prism, which are longer than are wide, in the depth direction of the ink chamber. In this case, the setting of the value of the remaining amount of ink is made freely variable by making variable the optical sensor position for detecting the prism.

A valve body capable of blocking the ink outlet and a spring member for pressing the valve body against the ink outlet are disposed between the communicating port and the ink outlet.

An ink-jet printer comprises: an ink-jet head for discharging ink, an ink tank for ejecting ink to be supplied to the ink-jet head, the ink tank further comprising:

a foam for absorbing and holding ink;

a foam containing chamber for containing the foam;

a vent port communicating with the foam containing chamber, the vent hole allowing atmospheric air to enter the foam containing chamber;

an ink outlet for taking out ink from the foam containing chamber;

an ink chamber for detecting the remaining amount of ink, the ink chamber being disposed between the foam containing chamber and the ink outlet, the ink chamber operable to receive ink and bubbles from the foam containing chamber and supply only the ink to the ink outlet while preventing the bubbles from entering to the ink outlet;

a prism having two interface surfaces provided on one of walls of the ink chamber, wherein the prism reflects light received at the prism when the ink fails to contact the prism, and refracts the light into the ink chamber when the ink contacts the prism, and an ink-end detecting mechanism having a light emitting element and a light receiving element capable of receiving the light emitted from the light emitting element and also reflected from the two interface surfaces, wherein the presence or absence of ink in the ink tank is detected according to the remaining amount of ink in the ink chamber by the amount of light reflected from the prism.

With the arrangement above, as only ink liquid is detected in the ink chamber, the remaining amount of ink is precisely detectable and the used amount of ink up to the real end is also calculable, so that waste of ink is reduced.

In the ink-jet printer, the ink tank includes:

a projected portion projecting from a bottom wall of the ink chamber; a communicating port formed at a front end of the projected portion, the communicating port communicating with the ink outlet; and a cap member for covering the projected portion, wherein a gap for sucking up ink is formed between the projected portion and the cap member, the gap being extended from the communicating port to the bottom wall of the ink chamber.

With the arrangement above, as the ink outlet can be disposed near the base of the ink chamber, it is possible to make the ink tank compact while an increase in its height is restrained.

Moreover, a greater amount of ink can be supplied to the ink-jet head and simultaneously ink in the ink chamber can also be sucked up without waste of ink.

BRIEF DESCRIPTION OF THE DRAWINGS

FIG. 4(*b*) a partial sectional view in such a condition that an ink supply needle is inserted;

DETAILED DESCRIPTION OF PREFERRED EMBODIMENTS

Ink tanks for ink-jet printers embodying the invention will now be described by reference to the drawings, each ink tank allowing an ink end to be detected by an ink-end detecting method according to the invention. The following embodiments of the invention refer to cases wherein the invention has been applied to the ink tanks detachably mounted on the tank mounting portions of the respective ink-jet printers. Moreover, the invention is also applicable to an ink tank prearranged in a ink-jet printer.

First Embodiment

Figure 12:
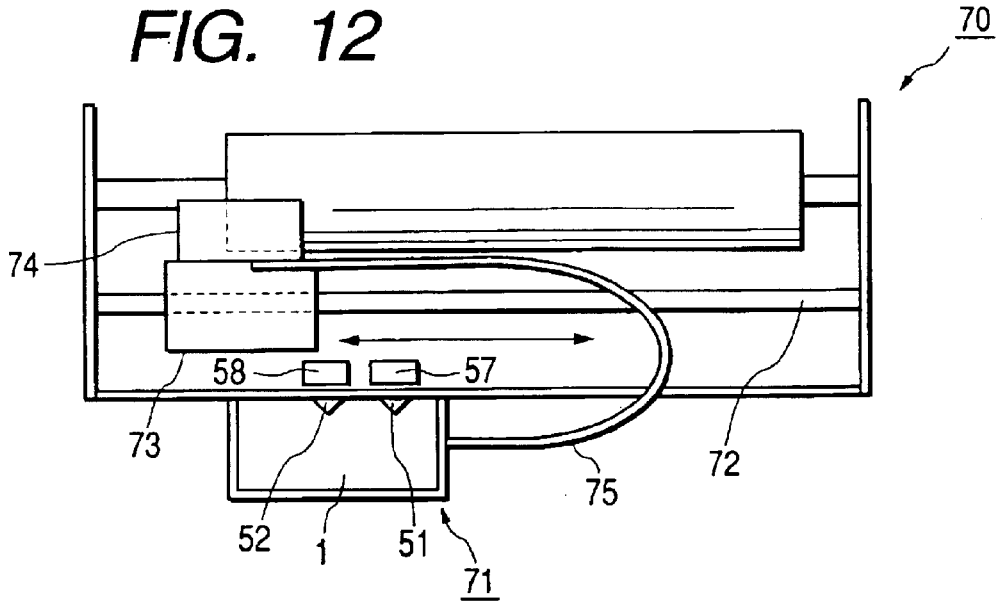
FIG. 12 is a schematic block diagram of the principal part of a serial ink-jet printer according to the invention.

FIG. 12 is a schematic block diagram of the principal part of an ink-jet printer to which the invention is applied.

An ink-jet printer 70 according to this embodiment of the invention is of a serial type wherein an ink-jet head 74 is loaded on a carriage 73 capable of reciprocating along a guide shaft 72. Ink is supplied from an ink tank 1 mounted on a tank mounting portion 71 via a flexible ink tube 75 to the ink-jet head 74.

Figure 1A:
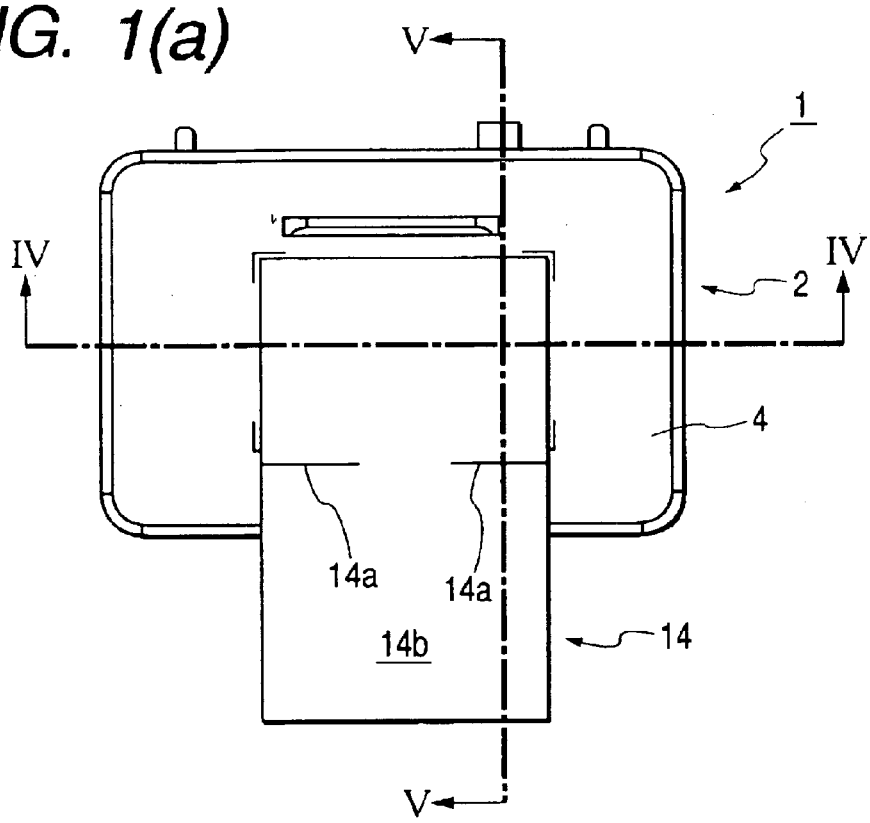
FIGS. 1(*a*) and (*b*) are a plan and an elevational view of a foam-type ink tank according to first embodiment of the invention.
Figure 1B:
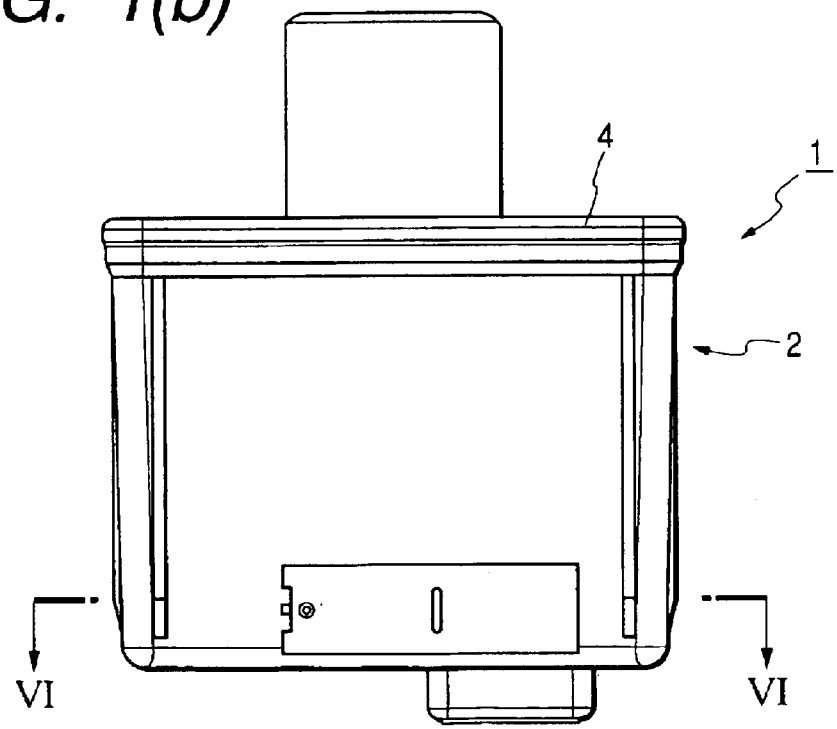
Figure 2:
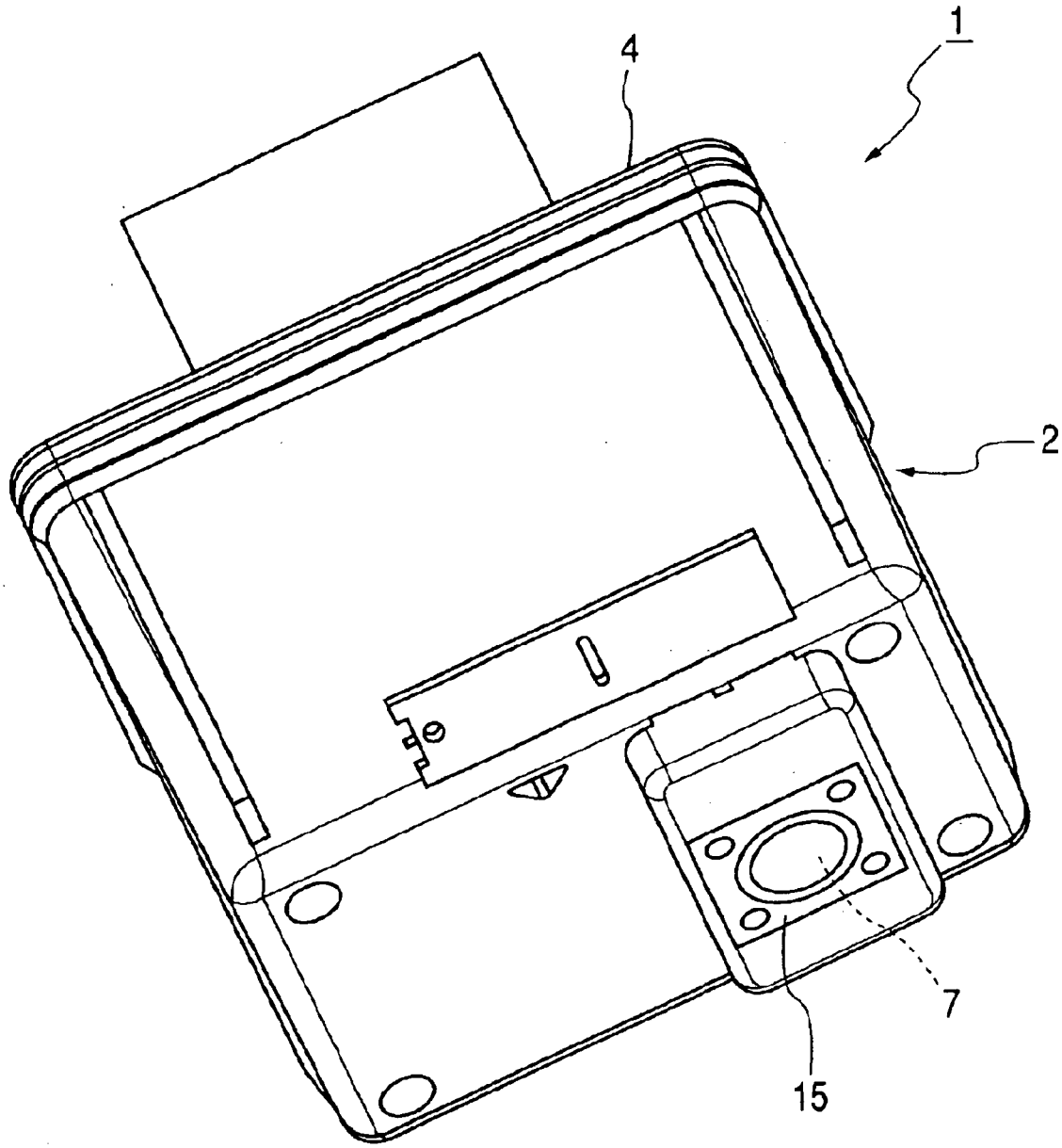
FIG. 2 is a perspective view of the ink tank of FIG. 1 as viewed from the base side.

FIGS. 1(*a*) and (*b*) are a plan and an elevational view of a foam-type ink tank according to a first embodiment of the invention; FIG. 2, a perspective view of the ink tank as viewed from the base side; and FIG. 3, an exploded perspective view of the ink tank.

The ink tank 1 for use in the first embodiment of the invention is detachably mounted on the tank mounting portion 71 formed in the ink-jet printer 70. The ink tank 1 has a container body 2 in the form of a rectangular parallelepiped with the upper side being opened and a container cover 4 for closing the upper-side opening 3. Inside the container body 2, a foam containing portion 5 is formed and a foam 6 that is in the form of a rectangular parallelepiped as a whole and that absorbs and holds ink is contained therein.

An ink outlet 7 is formed in the base of the container body 2 and a disc-like rubber packing 8 is fitted in the ink outlet 7 and further, a through-hole 8*a* bored in the center of the rubber packing 8 is used as an ink takeoff. A valve 9 capable of blocking off the ink takeoff 8*a* is disposed in an inner part deeper than the rubber packing 8 in the ink outlet 7 and always pressed against the rubber packing 8 by a coil spring 10 so as to block off the ink takeoff 8*a*.

The foam containing portion 5, as will be described in detail later, communicates with the ink outlet 7 via a first and a second filter 11 and 12. Further, the foam containing portion 5 is opened to the atmosphere via ports 13 communicating with the atmosphere that are formed in the container cover 4. When the ink absorbed and held by the foam 6 mounted in the foam containing portion 5 is sucked via the ink outlet 7, air corresponding to the ink thus sucked is introduced into the foam containing portion 5 from the ports 13 communicating with the atmosphere.

The ports 13 communicating with the atmosphere in the container cover 4 are linked with a winding groove 13*a* cut in the surface of the container cover and the end 13*b* of the groove 13*a* is extended substantially up to the edge end of the container cover 4. When the ink tank 1 is shipped, a seal 14 is pasted to the portion where the ports 13 communicating with the atmosphere in the container cover 4 and the groove 13*a* are formed, and the end 13*b* of the groove 13*a* is exposed by removing part 14*b* of the seal 14 along the perforated line 14*a* of the seal 14 at the time of use, so that the ports 13 communicating with the atmosphere are opened to the atmosphere.

Figure 4A:
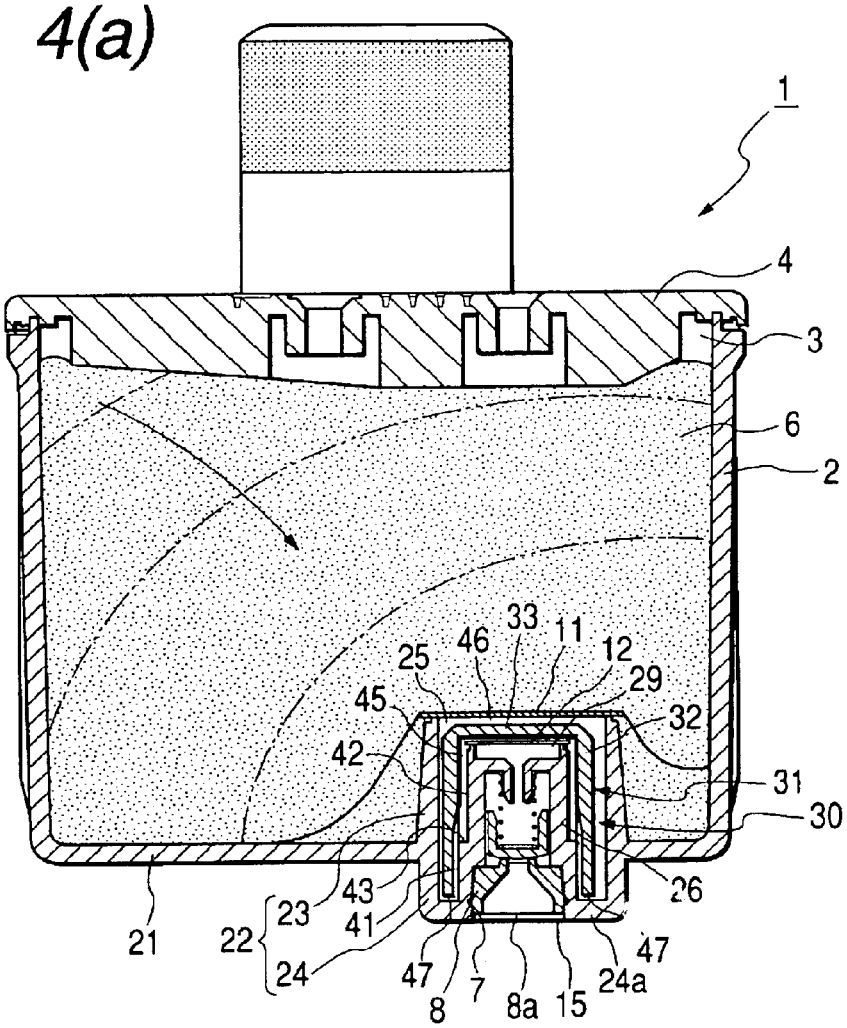
FIG. 4(*a*) is a sectional view of the ink tank taken on line IV—IV of FIG. 1.
Figure 4B:
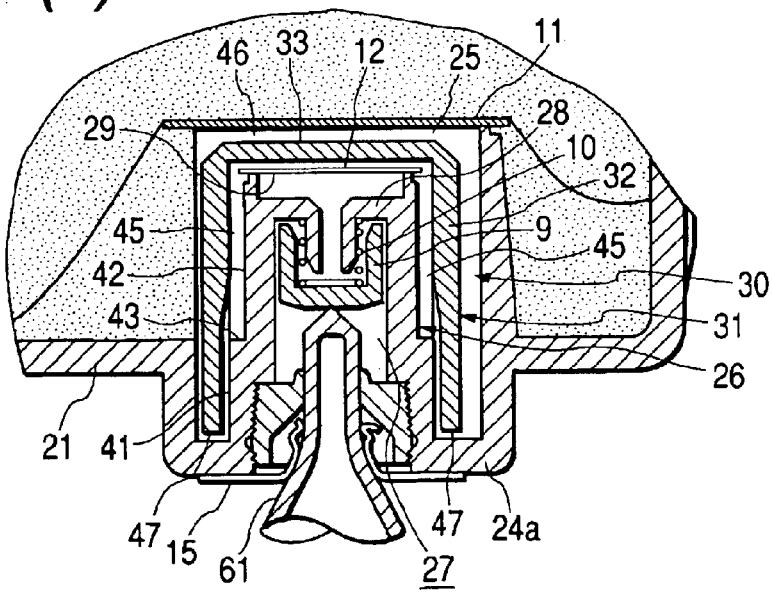

A seal 15 is also pasted to the portion of the ink takeoff 8*a* of the container base and when the ink tank 1 is mounted in the tank mounting portion of the ink-jet printer, an ink supply needle 61 fitted to the tank mounting portion breaks the seal 15 and is inserted into the ink takeoff 8*a*, whereby the ink tank is placed in the installed condition (see FIG. 4(*b*)).

Figure 5:
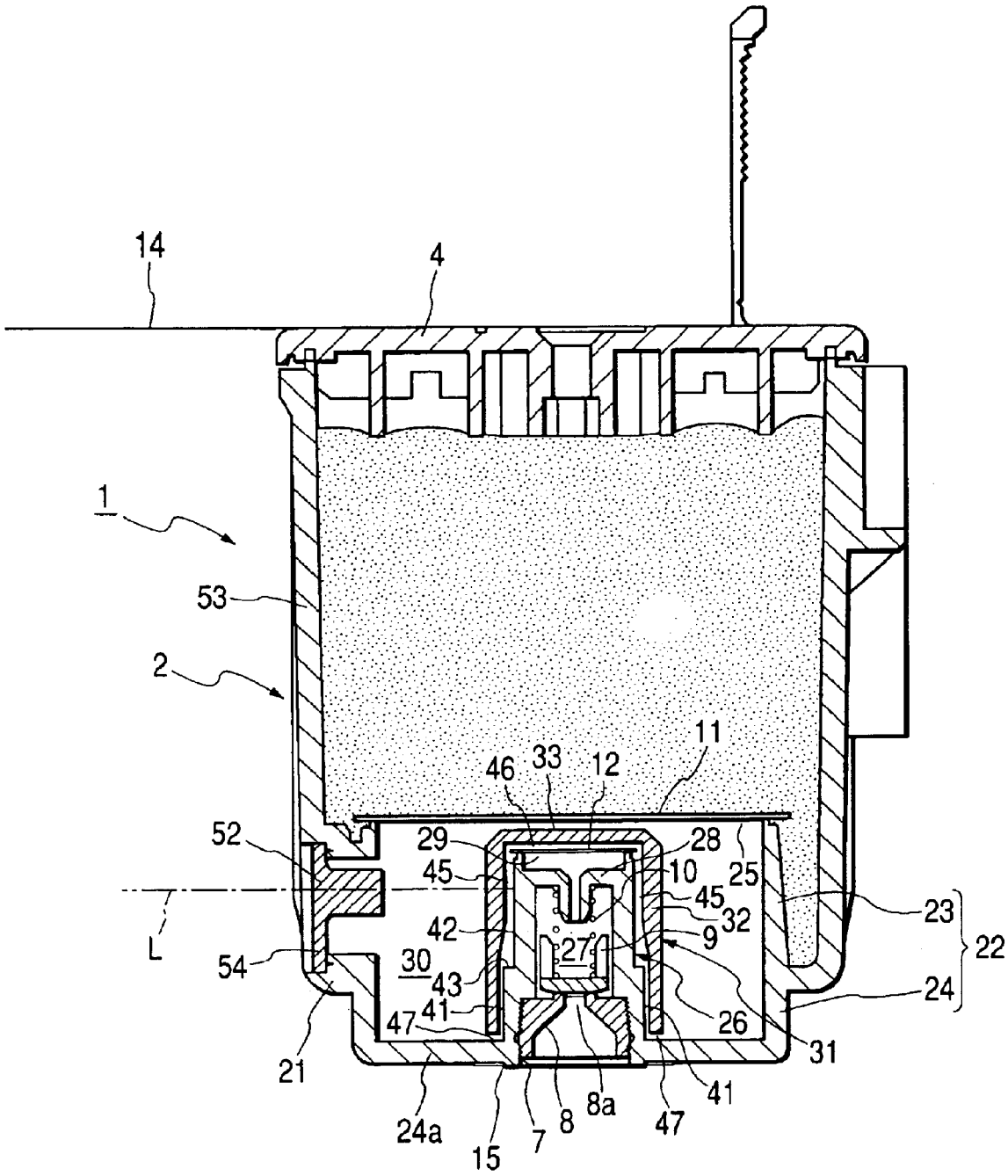
FIG. 5 is a sectional view of the ink tank taken on line V—V of FIG. 1.

FIGS. 4(*a*) and (*b*) are a sectional and a partial sectional view of the ink tank 1 taken on line IV—IV of FIG. 1; FIG. 5, a sectional view of the ink tank 1 taken on line V—V of FIG. 1; and FIG. 6, a sectional view of the ink tank 1 taken on line VI—VI of FIG. 1.

The structure of the ink passage portion formed between the ink outlet 7 and the foam containing portion 5 will be described by reference to these drawings. A cylindrical frame 22 in rectangular section is passed through the base portion 21 of the container body 2 and extended vertically. A rectangular communicating port 25 is formed in the upper end of an upper-side cylindrical frame portion 23 perpendicularly uprighted in the foam containing portion 5 in the cylindrical frame 22. The communicating port 25 is blocked by the first rectangular filter 11.

The lower end opening of a lower-side cylindrical frame portion 24 perpendicularly projecting downward from the container base portion 21 of the cylindrical frame 22 is blocked by a frame base portion 24*a* as a bottom wall integrally formed with the opening. Moreover, a cylindrically projected portion 26 perpendicularly extending upward is integrally formed at substantially the center of the frame base portion 24*a*. The central hole of the projected portion 26 is used as an ink passage 27 communicating with the ink outlet 7.

The rubber packing 8, the valve 9, and the coil spring 10 are fitted into the ink passage 27 and the spring bearing 28 of the coil spring 10 is integrally formed with the inner peripheral face of the projected portion 26.

The projected portion 26 is extended up to a position lower by a predetermined distance than the position of the first filter 11, and a circular communicating port 29 formed in the upper end of the projected portion 26 is blocked by the second filter 12.

Thus, an ink chamber or ink detecting chamber 30 is sectioned by the cylindrical frame 22 in rectangular section integrally formed with the container base portion 21 and the cylindrical projected portion 26 integrally formed with the inner part of the cylindrical frame 22 between the foam containing portion 5 and the ink outlet 7 in the ink tank 1 according to this embodiment of the invention. The ink chamber 30 communicates with the foam containing portion 5 via the communicating port 25 fitted with the first filter 11. Moreover, the ink chamber 30 communicates with the ink passage 27 via the communicating port 29 fitted with the second filter 12 and the lower end side of the ink passage 27 is linked with the ink outlet 7.

The first filter 11 according to this embodiment of the invention is formed of porous material capable of passing ink and of causing bubbles to pass therethrough by ink suction force acting on the ink outlet 7. In other words, the first filter 11 is formed of porous material having a pore size or sizes that produce capillary gravitation resulting in destroying the meniscus due to the ink suction force. The first filter 11 is formed of, for example, unwoven fabric, a mesh filter, or the like.

On the other hand, the second filter 12 is formed of porous material having a pore size or sizes smaller than that of the first filter 11 so that when the ink suction force acts on the ink outlet 7, excluding the time during which the suction operation is performed by an ink pump, bubbles are not allowed to pass the pores, but ink is allowed to pass therethrough. The pore size of the second filter 12 is large enough to catch alien substances mixed with ink. The second filter 12 may also be formed of unwoven fabric, a mesh filter or the like.

The ink suction force is derived from ink suction force acting on the ink outlet 7 due to ink discharge pressure in the ink-jet head 74 as an object for being supplied with ink or the suction force of the ink pump.

Further, a cup-like cap 31 in the form of a cylindrical container with the lower side being open and for use in sucking up ink is disposed in the ink chamber 30. The cup-like cap 31 is so arranged as to suck the ink gathered on the base of the ink chamber 30 up to the communicating port 29 where the second filter 12 is fitted in.

Figure 6:
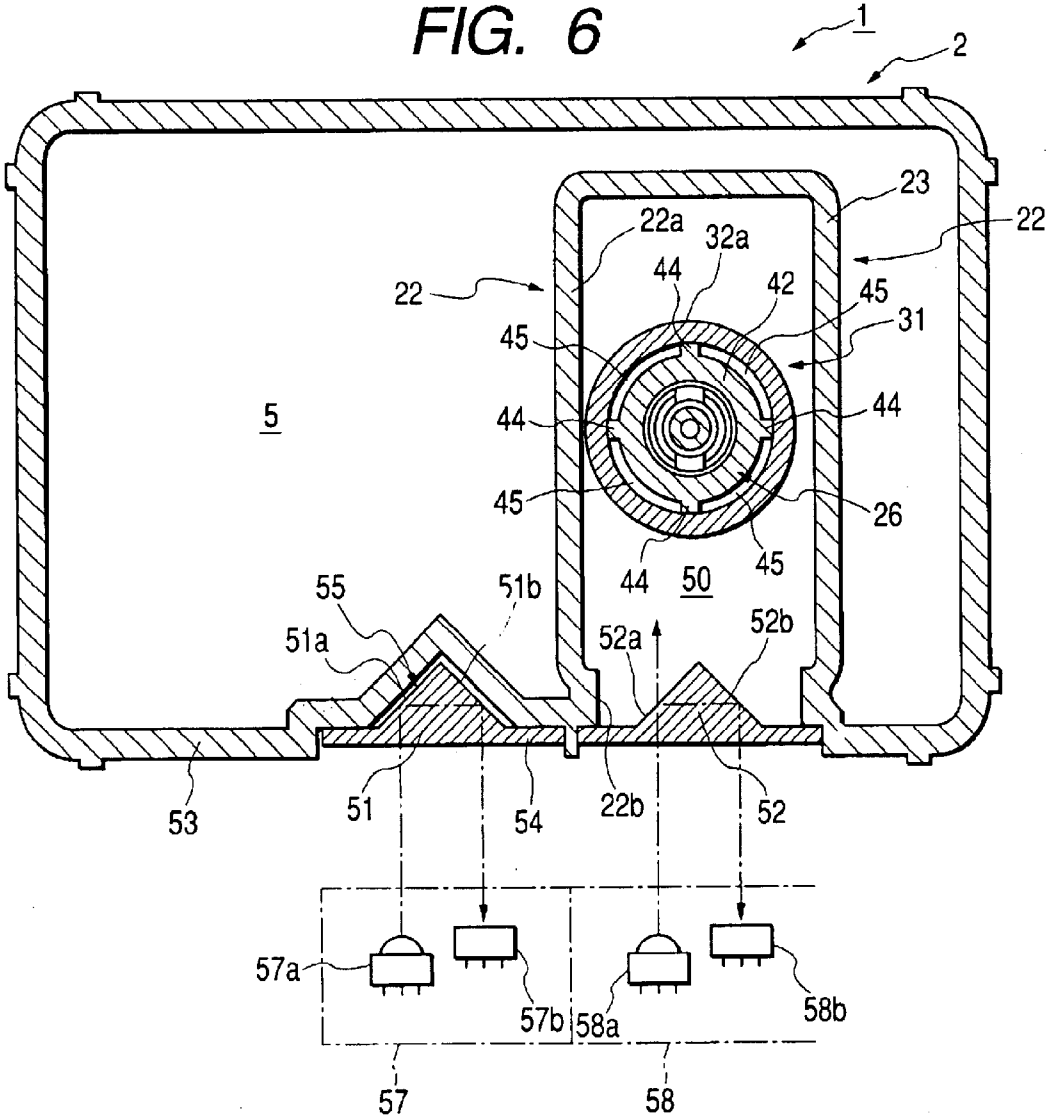
FIG. 6 is a sectional view of the ink tank taken on line VI—VI of FIG. 1.
Figure 7A:
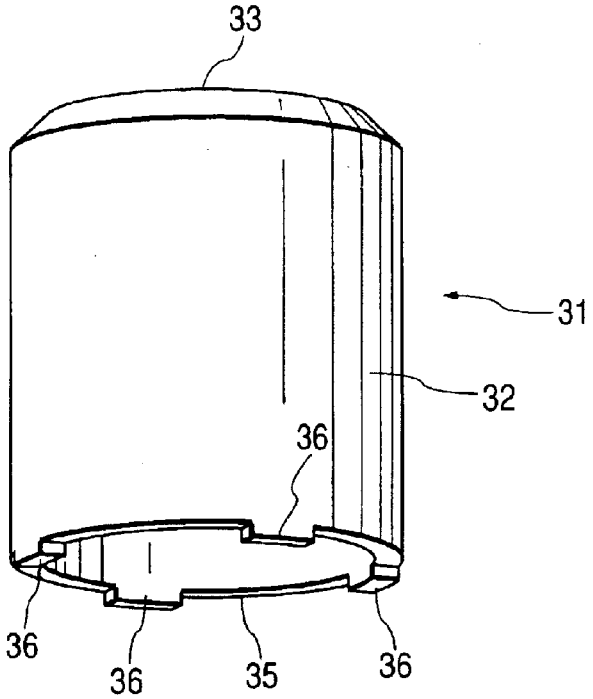
FIG. 7(*a*) and FIG. 7(*b*) are a perspective and a sectional view of the cup-like cap disposed in the ink chamber of the ink tank of FIG. 1.
Figure 7B:
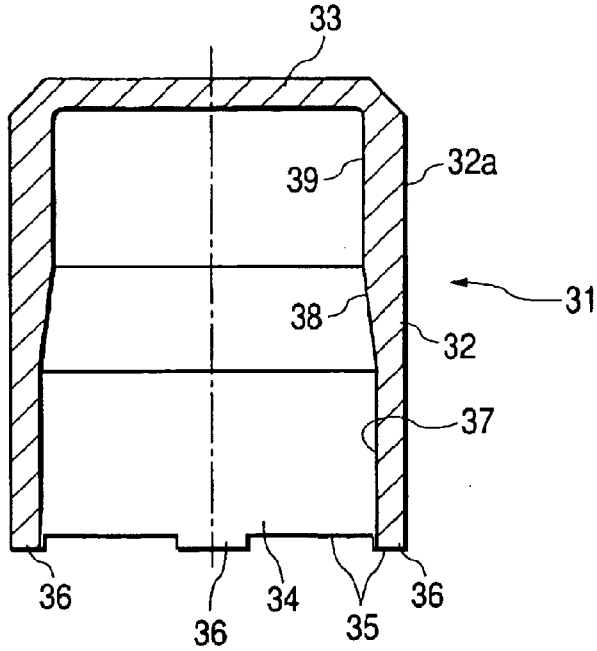

FIGS. 7(*a*) and (*b*) are a perspective and a sectional view of the cup-like cap 31. Referring to FIGS. 4 to 7, the cup-like cap 31 has a cylindrical body portion 32 and a top portion 33 for blocking the upper-end opening of the body portion 32. A plurality of projections formed at predetermined angular intervals are perpendicularly projected from the circular edge face 35 of the lower end opening 34. According to this embodiment of the invention, four projections 36 having the same height are formed at 90-degree intervals. The inner peripheral face of the cylindrical body portion 32 is provided with an inner peripheral face portion 37 on the lower end side, a tapered inner peripheral face portion 38 slightly coming inward and continuous to the upper side of the face portion 37, and a small-diameter upper-end-side inner peripheral face portion 39 continuous to the upper side of the face portion 38.

The cup-like cap 31 is installed in such a manner as to cap the cylindrical projected portion 26 formed in the ink chamber 30 from above. The outer peripheral face of the projected portion 26 is made an outer peripheral face portion 41 whose lower end side portion has a slightly large diameter and the upper-end-side portion is made a small-diameter outer peripheral face portion 42, an annular stepped face 43 being formed between these outer peripheral portions 41 and 42. As shown in FIG. 6, ribs 44 projecting outward are formed at predetermined angular intervals in the small-diameter outer peripheral face portion 42. According to this embodiment of the invention, four ribs 44 are formed at 90-degree intervals and have the same amount of projection as well as a predetermined length in the vertical direction. Moreover, the amount of projection of the ribs 44 is set so that the ribs fit into the upper-end-side outer peripheral face portion of the cup-like cap 31.

When the projected portion 26 is capped with the cup-like cap 31, the positioning of the cup-like cap 31 is fixed by the four ribs 44, whereby four gaps 45 in arcuate section for sucking ink are formed between the inner peripheral face of the cup-like cap 31 and the outer peripheral face of the projected portion. Moreover, the height of a section ranging from the underside of each projection 36 formed on the circular edge face 35 at the lower end of the cup-like cap 31 up to the back of the top portion 33 is set greater by a predetermined value than the height of the projected portion 26. In this capped condition, a gap 46 for use as an ink passage having a predetermined space is consequently formed between the second filter 12 fitted to the upper end of the projected portion 26 and the back of the top portion 33, the gap 46 communicating with the gaps 45. In the capped condition, further, four gaps 47 in arcuate section having predetermined width are formed among the four projections 36 formed at the lower end of the cup-like cap 31. The gaps 47 in arcuate section also communicate with the gaps 45 in arcuate section, respectively. Thus, each of the gaps 47 acts as a communicating section.

By setting proper width to the gaps 45, 46 and 47, ink is sucked from the gaps 47 through the gaps 45 and then passed through the gap 46 to reach the communicating port 29 at the upper end of the projected portion, whereby an ink suction passage can be formed. Thus, the gathered amount of ink in the ink chamber 30 decreases and even when the liquid level becomes lower than the position of the second filter 12, the ink in the ink chamber can be sucked up to the position of the second filter 12 and supplied to the ink outlet 7 from the ink passage 27.

Further, according to this embodiment of the invention, the outer peripheral face 32*a* of the cup-like cap 31 is arranged so that it is kept separated by a predetermined width from the inner side face 22*a* of the cylindrical frame 22 used to form the ink chamber 30. When the outer peripheral face 32*a* of the cup-like cap 31 is brought into contact with the inner side face 22*a* of the cylindrical frame 22, the inside of the ink chamber is divided into right and left sections with the contact position as a boundary and it is feared that the ink gathered in the ink chamber may not efficiently be sucked up. According to this embodiment of the invention, the ink gathered in the ink chamber can efficiently be sucked up by the cup-like cap 31.

Next, a rectangular prism 51, for use in optically detecting whether the ink tank 1 is mounted in the tank mounting portion of the ink-jet printer, is formed in the ink tank 1 according to this embodiment of the invention. Moreover, a rectangular prism 52, for use in optically detecting whether the remaining amount of ink left in the ink chamber 30 falls below the predetermined amount, is also formed therein.

Figure 3:
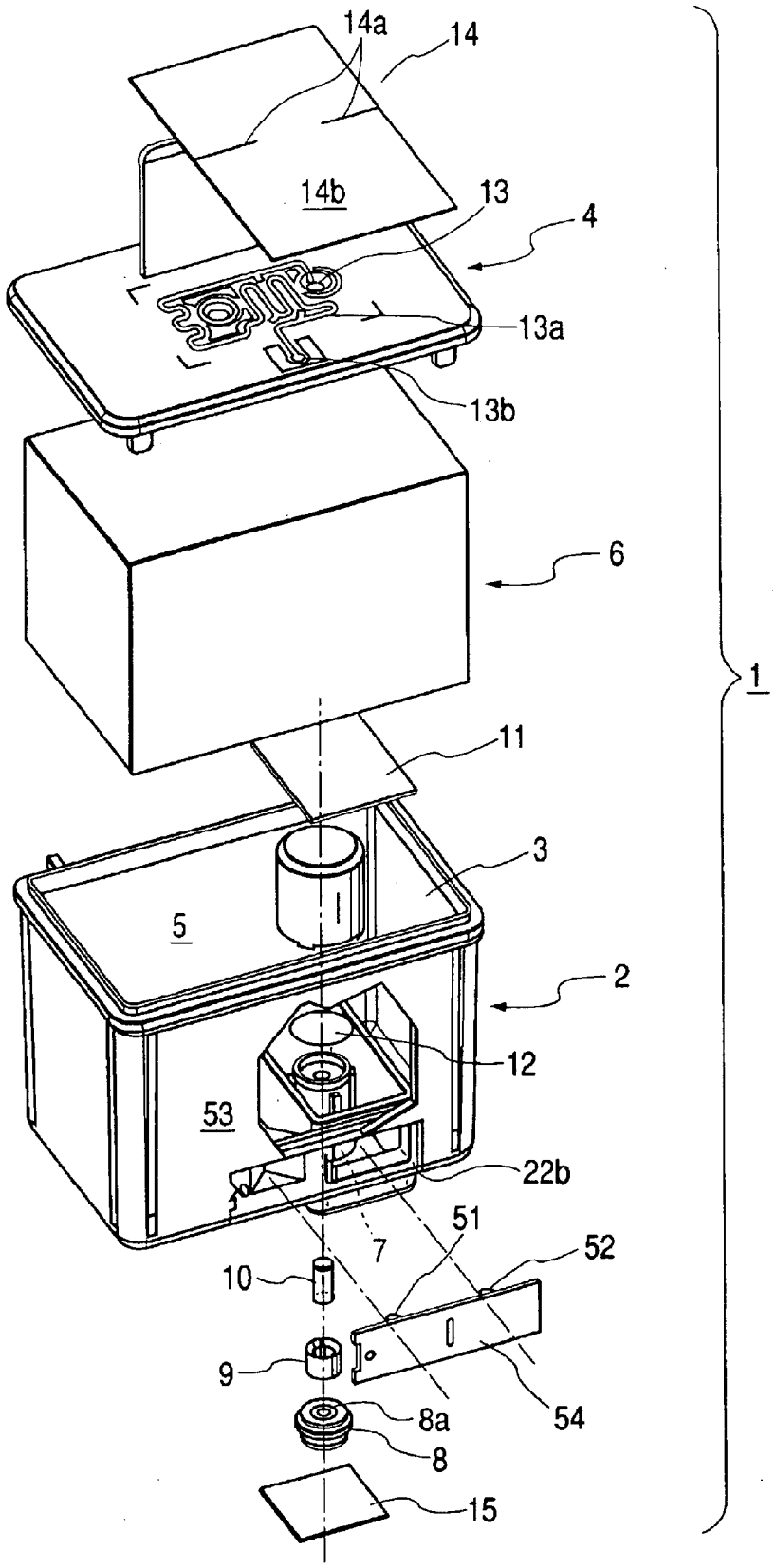
FIG. 3 is an exploded perspective view of the ink tank of FIG. 1.

Referring to FIGS. 3, 5 and 6, a rectangular plate 54 is fusion fixed to the lower end portion of the side plate portion 53 of the container body 2 and the rectangular prisms 51 and 52 are spaced apart from each other as prescribed and integrally formed with the inner side of the rectangular plate 54. These rectangular prisms 51 and 52 are at right angles to pairs of reflective surfaces 51*a* and 51*b*, and 52*a* and 52*b*, respectively.

The rectangular prism 51 on one side faces the side plate portion 53 of the container body via an air layer 55 having a predetermined space. In further explanation, a depressed portion 56 so configured as to correspond to the rectangular prism 51 is formed in the side plate portion 53, whereby each of the reflective surfaces 51*a* and 51*b* faces the side plate portion 53 of the foam containing portion 5 via the air layer 55 having the predetermined space.

On the other hand, the rectangular prism 52 on the other side is directly exposed to the inside of the ink chamber 30 from an opening 22*b* bored in the cylindrical frame 22 that forms the section of the ink chamber 30. Therefore, when the ink liquid level in the ink chamber 30 remains above the mounting position of the rectangular prism 52, each of the reflective surfaces 52*a* and 52*b* does not function as a reflective surface coming in contact with ink. However, each of the reflective surfaces 52*a* and 52*b* functions originally as a reflective surface when the ink liquid level lowers.

In this case, as shown in FIGS. 6 and 12, reflection type optical sensors 57 and 58 are mounted on the side of the ink-jet printer 70 in which the ink tank 1 is mounted. The optical sensors 57 and 58 have light emitting elements 57*a* and 58*a* and light receiving elements 57*b* and 58*b*. The optical sensor 57 is so positioned that by causing the light emitted from the light emitting element 57*a* to be incident on the reflective surface 51*a* at an angle of 45 degrees, the return light reflected from the reflective surface 51*a* and the reflective surface 51*b* may be received by the light receiving element 57*b*. Similarly, the optical sensor 58 is also so positioned that by causing the light emitted from the light emitting element 58*a* to be incident on the reflective surface 52*a* at an angle of 45 degrees, the return light reflected from the reflective surface 52*a* and the reflective surface 52*b* may be received by the light receiving element 58*b*.

Detection of whether the ink tank 1 according to this embodiment of the invention is mounted in the tank mounting portion of the ink-jet printer and detection of an ink end in the ink tank 1 are carried out in the following manner.

When an ink cartridge 11 is mounted in the tank mounting portion of the ink-jet printer, the tip of the ink supply needle 61 disposed on the ink-jet printer side is passed through the through-hole 8*a* of the rubber packing 8 fitted into the ink outlet 7 of the ink tank 1, whereby the valve 9 positioned inside the ink passage 27 is pushed up as shown in FIG. 4(*b*).

Consequently, the ink absorbed and held by the foam 6 in the foam containing portion 5 of the ink tank 1 is caused to flow into the ink passage 27 via the first filter 11, and the ink chamber 30 as the ink outlet 7 is kept open and then passed through the ink supply needle 61, so that the ink can be supplied to the ink-jet head on the ink-jet printer side. Since the invention is compatible with ink supply mechanisms in the related art, a further detailed description of the ink supply mechanism will be omitted.

When the ink tank 1 is thus mounted, the rectangular prism 51 formed on the side of the ink tank comes to face the optical sensor 57 on the ink-jet printer side. Therefore, the light emitted from the optical sensor 57 is reflected from the reflective surfaces 51*a* and 51*b* of the rectangular prism 51 and then received by the optical sensor 57, whereby it is detected that the ink tank 1 has been mounted.

When ink is discharged after the ink-jet head is driven, the ink suction force acts on the ink outlet 7 due to the ink discharge pressure, so that ink is supplied toward the ink-jet head. When the ink held by the foam 6 decreases after ink is thus supplied, air is introduced into the foam containing portion 5 via the ports 13 communicating with the atmosphere. As shown by a chain line in FIG. 4(*a*), the ink contained in the foam 6 gradually decreases as the consumption of ink increases and bubbles come into the foam 6. Then, the bubbles pass through the first filter 11 and enter the ink chamber 30 as the remaining amount of ink in the foam 6 decreases. In this case, since the cup-like cap 31 is always filled up with ink, bubbles are not allowed to flow downstream beyond the second filter 12 unless ink in the ink chamber 30 is running out. Accordingly, bubbles are gradually gathered in the ink chamber 30.

It has been arranged that the second filter 12 is provided according to this embodiment of the invention. When the cup-like cap 31 is employed, however, ink can be sucked up similarly even though the second filter 12 is absent.

When the remaining amount of ink decreases further, the liquid level of ink stored in the foam containing portion 5 and the ink chamber 30 gradually lowers and the pair of reflective surfaces 52*a* and 52*b* of the rectangular prism 52 exposed to the inside of the ink chamber 30 are gradually exposed from the liquid level of ink. Consequently, the pair of the reflective surfaces 52*a* and 52*b* start functioning as reflective surfaces. When the liquid level of ink in the ink chamber 30 falls below a predetermined liquid level position (e.g., a position L in FIG. 5), the amount of light received by the light receiving element 58*b* of the optical sensor 58 exceeds a predetermined amount of light to be received thereby. Detection of whether ink in the ink tank 1 is running out (ink end) is based on an increase in the amount of light received by the light receiving element 58*b*.

In a case where the capacity of the ink chamber 30 is set sufficiently small, as the ink end is detected at a point of time where the remaining amount of ink is running short, the ink end is made detectable from a condition in which the remaining amount of ink is reduced to the smallest possible degree, whereby ink is prevented from being wasted.

Incidentally, the ink liquid-level detecting position L is preferably set in a position slightly lower (by 1 mm–2 mm) than that of the filter 11. When the filter 11 is arranged as close as possible to the detecting position L, introduction of even a small amount of bubbles into the ink chamber may allow the ink end to be detected then because of the ink suction force or an impact, despite the fact that ink is being supplied from the inside of the foam 6 to the ink chamber 30. That is, a takeoff amount of ink may decrease too much. In order for the ink end to be detected at a point of time where the ink in the foam 6 is substantially all consumed, the ink liquid-level detecting position L is set in a position slightly lower than that of the filter 11, whereby even though bubbles are taken into the ink chamber 30 abnormally quickly, no ink end is detected with the effect of reducing variation in the takeoff amount of ink.

In a case where the above condition is dealt with by regarding the condition as being a near end, the wasting of ink can be obviated further. More specifically, an amount of ink to be used thereafter is calculated after the near end of ink is detected by the optical sensor 58 so that the real end is decided when the calculated value reaches an amount equivalent to the capacity of the ink chamber 30. Thus, ink is usable until the time the remaining amount of ink is substantially reduced to zero.

According to this embodiment of the invention, the cup-like cap 31 is especially employed as a mechanism for sucking up the ink gathered in the base portion of the ink chamber 30 up to the position of the second filter 12. When the real end detection is carried out by calculating the used amount of ink from the detection of the near end of ink by the optical sensor 58, the ink gathered in the ink chamber 30 is substantially totally sucked up before being supplied from the ink outlet 7 to the ink-jet head. Consequently, the real end of ink can be detected at a point of time when the ink in the ink chamber 30 has substantially run out, whereby the precision of the real-end detection is improved.

Figure 8:
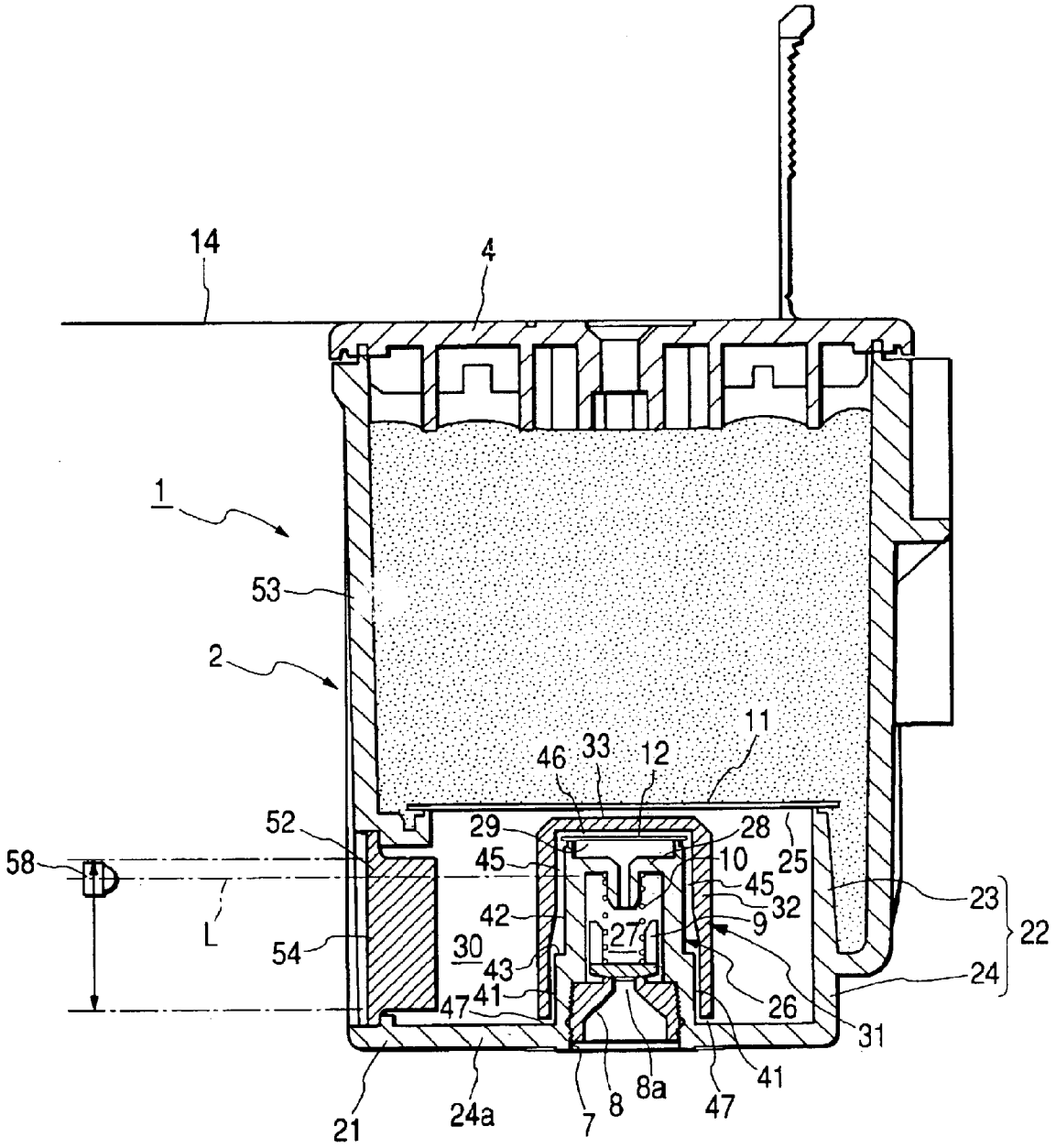
FIG. 8 is a diagram showing an example of a case where reflective surfaces of a prism are formed to be longer than they are wide in the ink tank of FIG. 1 with a sectional view taken on line V—V of FIG. 1.

As shown in FIG. 8, further, by forming the pair of reflective surfaces 52*a* and 52*b* of the rectangular prism 52 such that they are longer than they are wide in the depth direction of the ink chamber 30 and setting the position of the optical sensor 58 vertically variable, the remaining amount of ink from the detection of the near end of ink up to the real end can freely be set by the user.

In a case where the near end condition of ink is remotely monitored over a network, for example, the position of the optical sensor 58 is preset upward in such a condition that the ink tank 1 would not be replaced with a new one by a maintenance man, and the amount of ink from the near end up to the real end of ink is increased. Thus, the equipment loaded with the ink tank 1 can efficiently be operated without suspending the operation thereof.

In a case where the ink tank 1 is immediately replaceable with a new one by a maintenance man, the position of the optical sensor 58 is preset downward so that ink can effectively be utilized to the fullest as the used portion of ink is made reducible by calculating the discharge amount of ink from the ink-jet head and the sucked amount of ink by the ink pump.

In this case, the reflective surface of the rectangular prism 52 is preferably directed perpendicularly to the frame base portion 24*a*, but may be formed obliquely with respect to the frame base portion 24*a* depending on the moving direction of the optical sensor.

As set forth above, in the ink tank 1 according to this embodiment of the invention, the small-capacity ink chamber 30 is formed between the foam containing portion 5 and the ink outlet 7 whereby to make bubbles introducible into the ink chamber 30 from the side of the foam containing portion 5. Moreover, bubbles are prevented from flowing out of the ink chamber 30 toward the side of the ink outlet 7, and the ink end in the ink tank 1 is detected according to the remaining amount of ink in the ink chamber 30. Consequently, the ink end can be detected highly precisely in comparison with a case where the ink end in the ink tank 1 is detected by counting the number of ink discharges from the ink tank 1 and calculating the sucked amount of ink by the ink pump. Thus, the remaining amount of ink in the ink tank at the time of detecting the ink end can be lowered with the effect of reducing waste of ink.

According to this embodiment of the invention, moreover, a gap for use in sucking up ink to the second filter 12 positioned above the base portion of the ink chamber 30 is sectioned by using the cup-like cap 31. As the gap for use in sucking up ink is formed like this, the remaining amount of ink in the ink chamber 30 is reducible and ink utilizing efficiency is also improvable.

Although ink can be sucked up by capillary force of an ink absorbing material, ink can be sucked up by following the ink suction force of a side to be supplied with ink as compared with a case where the capillary force of the ink absorbing material is utilized when the gap for use in sucking ink is formed. Therefore, ink is prevented from running out when a large amount of ink is sucked up and it is also possible to suppress variation in the sucked-up amount of ink caused by fluctuation in the amount of ink supplied (flow rate) to the ink-jet head side or in the negative pressure condition in the ink tank.

According to this embodiment of the invention, further, as the ink-end detecting structure has been made compact by projecting the ink passage 27 led to the ink outlet 7 inside the ink chamber 30, the advantage is that an increase in the installation space of the ink tank is restrained. As the valve 9 and the coil spring 10 for blocking the ink outlet are disposed in the ink passage 27, the ink takeoff portion can also be made compact thereby.

Second Embodiment

Figure 9:
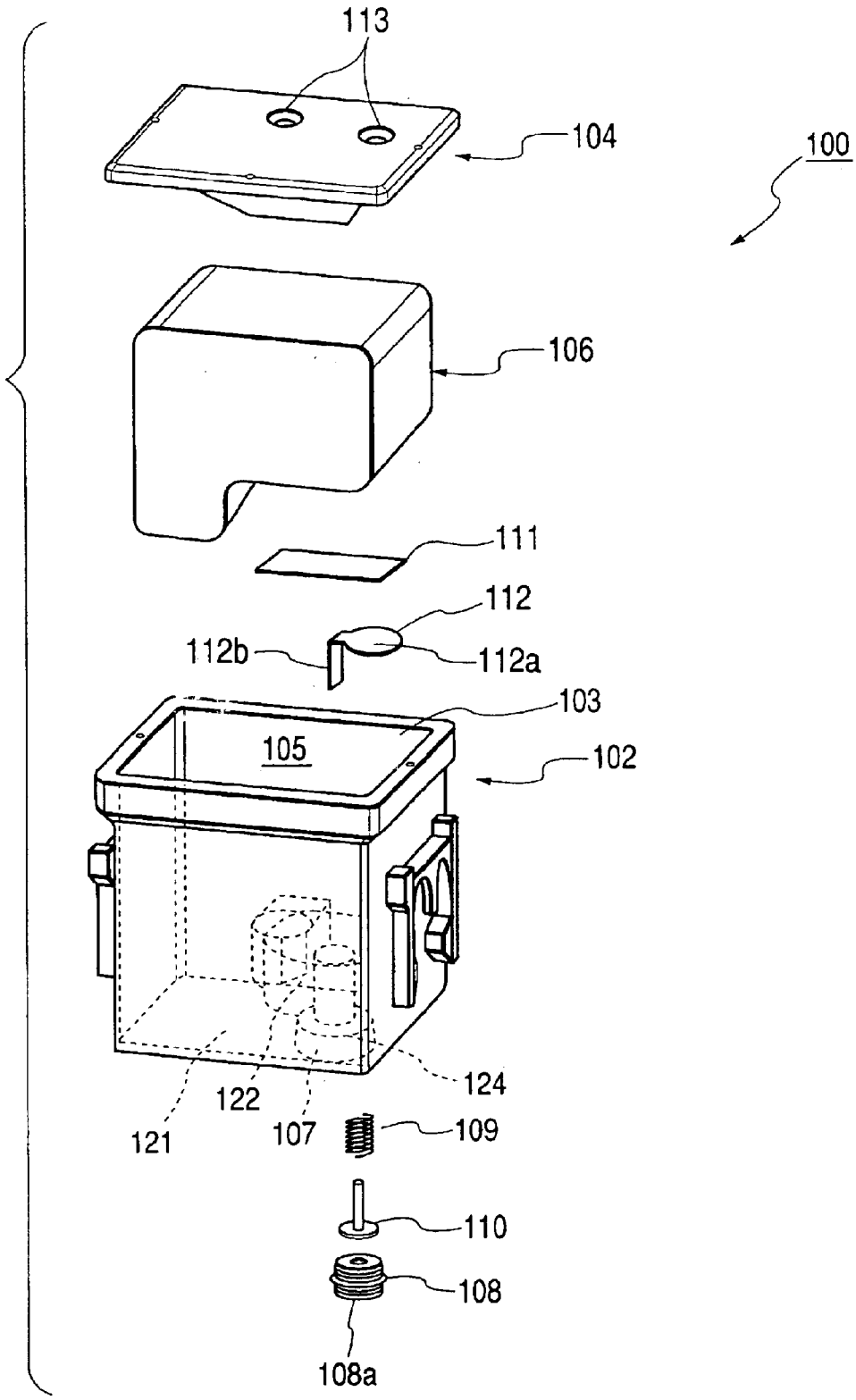
FIG. 9 is an exploded perspective view of an ink tank according to a second embodiment of the invention.

FIG. 9 is an exploded schematic view of a foam-type ink tank according to second embodiment of the invention. An ink tank 100 according to this embodiment of the invention has a container body 102 in the form of a rectangular parallelepiped with the upper side being open and a container cover 104 for blocking the upper-side opening 103. A foam containing portion 105 is formed with the container body 102 and the container cover 104. A foam 106 in the form of a rectangular parallelepiped that absorbs and holds ink is contained in the foam containing portion 105.

An ink outlet 107 is formed in the base of the container body 102 and a disc-like rubber packing 108 is fitted in the ink outlet 107 and further, a through-hole 108*a* bored in the center of the rubber packing 108 is used as an ink takeoff. The ink outlet 107 is blocked by a valve 110 normally pressed against the rubber packing 108 by a coil spring 109.

The foam containing portion 105, as will be described in detail later, communicates with the ink outlet 107 via a first and a second filter 111 and 112. On the other hand, ports 13 communicating with the atmosphere are formed in the container cover 104 and when ink is sucked from the ink outlet 107, air corresponding to the ink thus sucked is introduced into the foam containing portion 105 from the ports 113 communicating with the atmosphere.

Figure 10:
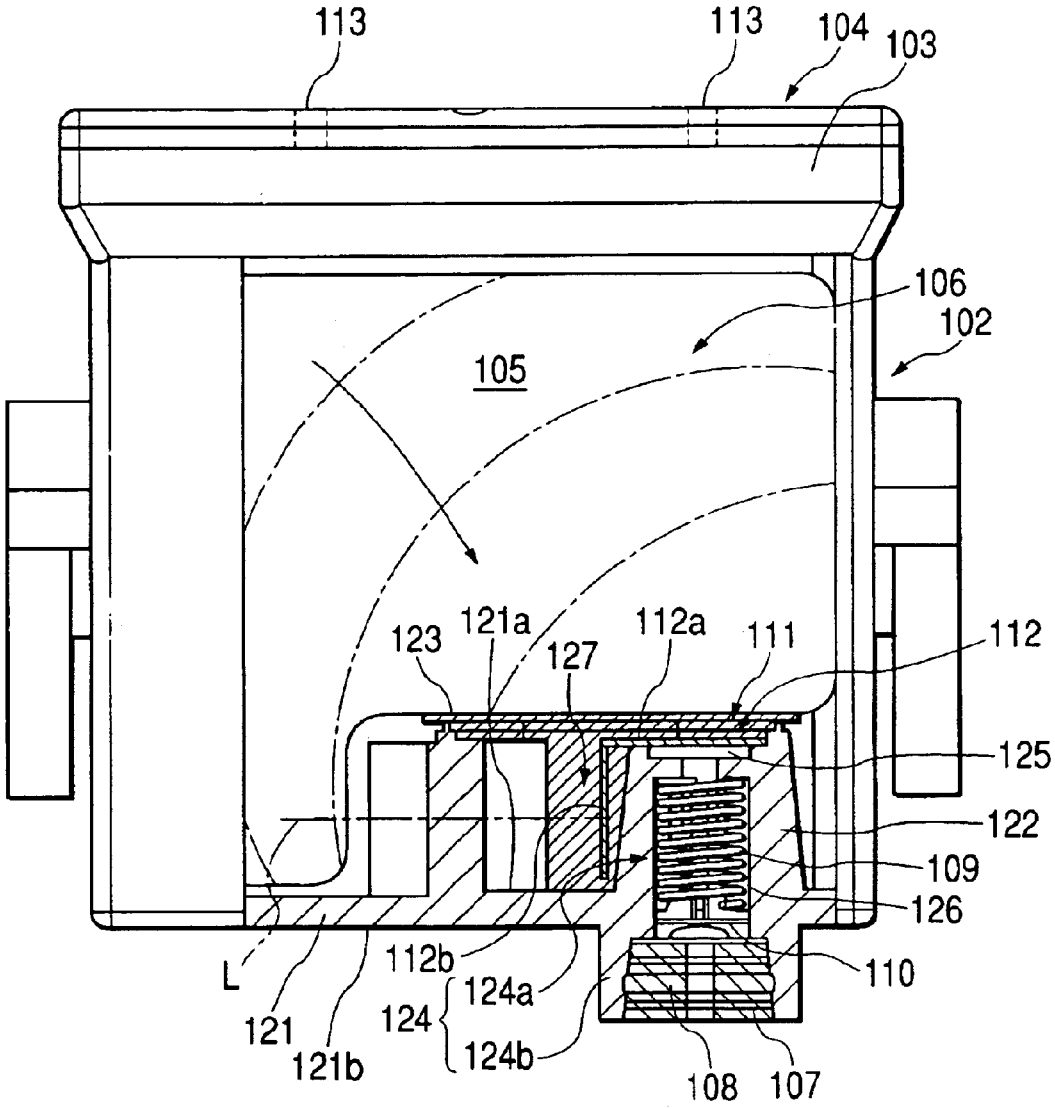
FIG. 10 is a sectional view of the ink tank of FIG. 9.
Figure 11:
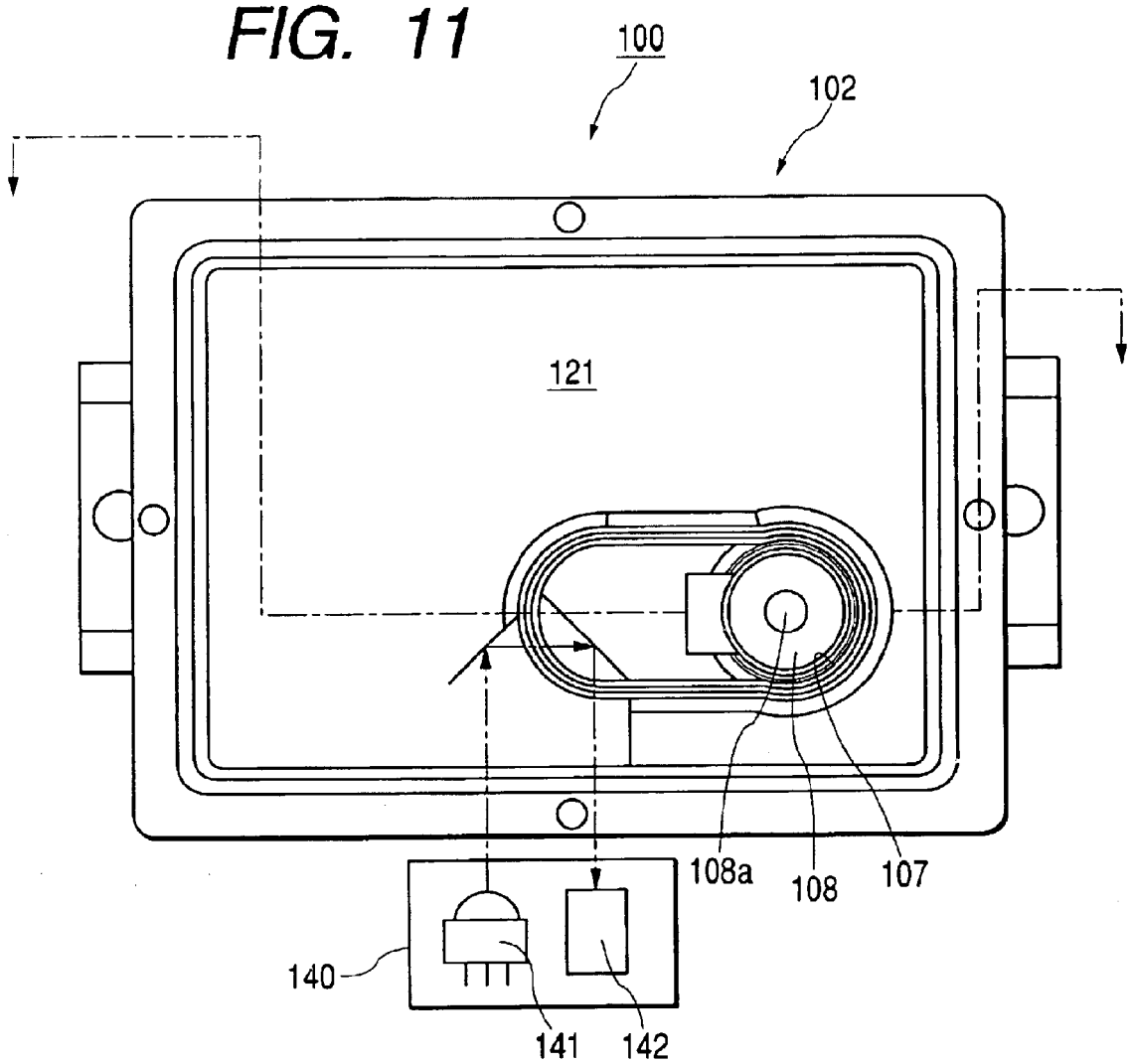
FIG. 11 is a bottom view of the ink tank of FIG. 9.

FIG. 10 is a sectional view of the ink tank 100; and FIG. 11, a bottom view thereof. The structure of an ink passage portion formed between the ink outlet 107 and the foam containing portion 105 will be described by reference to these drawings. A cylindrical frame 122 in elliptical section is perpendicularly uprighted from the base portion 121 of the container body 102 in the foam containing portion 105. A rectangular communicating port 123 is formed in the upper end of the cylindrical frame 22. The communicating port 123 is blocked by the first rectangular filter 111.

A cylindrical frame 124 in circular section, part of which is shared by the cylindrical frame 122, is formed on one side of the inside of the cylindrical frame 122. The cylindrical frame 124 is provided with an upper-side projected portion 124*a* perpendicularly projecting upward from the surface 121*a* of a container base portion 121 and a lower-side projected portion 124*b* perpendicularly projecting downward from the undersurface 121*b*. The upper end opening 125 (communicating port) of the upper-side projected portion 124*a* is positioned right below the communicating port 123 to which the first filter 111 is fitted and also blocked by the second filter 112.

The lower end opening of the lower-side projected portion 124*b* is used as the ink outlet 107 and the disc-like rubber packing 108 is fitted in the ink outlet liquid-tight. An ink passage 126 in circular section is formed between the upper end opening 125 and the ink outlet 107 as a lower end opening. The coil spring 109 and the valve 110 are fitted in the ink passage 126.

Thus, an ink chamber 127 is sectioned by the container base portion 121, the cylindrical frame 122 in elliptical section and the cylindrical frame 124 in circular section between the foam containing portion 105 and the ink outlet 107 in the ink tank 100 according to this embodiment of the invention. The ink chamber 127 communicates with the foam containing portion 105 via the communicating port 123 fitted with the first filter 111. Moreover, the ink chamber 127 communicates with the ink passage 126 via the upper end opening 125 fitted with the second filter 112 and the lower end side of the ink passage 126 is linked with the ink outlet 107.

The first filter 111 according to this embodiment of the invention is formed of porous material capable of passing ink and of causing bubbles to pass therethrough by ink suction force acting on the ink outlet 107. In other words, the first filter 111 is formed of porous material having a pore size or sizes that produce capillary gravitation resulting in destroying the meniscus due to the ink suction force. The first filter 111 is formed of, for example, unwoven fabric, a mesh filter or the like.

On the other hand, the second filter 112 is formed of porous material having a pore size or sizes smaller than that of the first filter 111. The pore size of the second filter 112 is large enough to catch alien substances mixed with ink. The second filter 112 may also be formed of unwoven fabric, a mesh filter or the like.

The ink suction force is derived from an ink suction force acting on the ink outlet 107 due to ink discharge pressure in an ink-jet head (not shown) as an object for being supplied with ink or the suction force of the ink pump.

The second filter 112 according to this embodiment of the invention is provided with a filter body portion 112*a* for blocking the upper end opening 125, and an absorption material portion 112*b* for sucking up ink, which absorption material portion is perpendicularly bent from one end of the filter body portion and extended downward, the lower end of the absorption material portion 112*b* for sucking up ink being extended up to the vicinity of the base of ink chamber 127. Instead of providing such an absorption material portion 112*b* for the second filter 112, another absorption material for sucking up ink may be used.

Next, a rectangular prism 130 having a pair of rectangular reflective surfaces 131 and 132, for use in detecting whether the remaining amount of ink that gathered in the ink chamber 127 falls below a predetermined amount, is formed in the ink tank 100 according to this embodiment of the invention. The rectangular prism 130 is formed integrally with the base portion 121 and the side plate portion 129 of the container body 102. These reflective surfaces 131 and 132 are formed so as to hold a side plate portion 122*a* on the side that projects into the foam containing portion 105 in the cylindrical frame 122 in elliptical section therebetween. The reflective surface 131 is positioned on the side of the foam containing portion 105, whereas the other reflective surface 132 is positioned in the ink chamber 127. Consequently, the backs of these reflective surfaces 131 and 132 form the respective interfaces of ink and the reflective surfaces do not function as reflective surfaces while ink is present but function as reflective surfaces when ink runs short.

In this case, as shown in FIG. 11, a reflection type optical sensor 140 is mounted on the side of the ink-jet printer (not shown) in which the ink tank 100 is mounted. This optical sensor 140 has a light emitting element 141 and a light receiving element 142. The positional relation between the light emitting element 141 and the reflective surface 131 is set so that the light emitted from the light emitting element 141 hits on the one reflective surface 131 positioned in the foam containing portion. Moreover, the light receiving element 142 is so positioned as to be able to receive the light reflected from the reflective surface 132 positioned in the ink chamber 127 after being reflected from the reflective surface 131.

The fact that the ink stored in the ink tank 100 according to this embodiment of the invention has run out can be detected by the reflection type optical sensor 140 disposed on the ink-jet printer side in the following manner.

When the ink tank 100 is mounted in the predetermined portion of the ink-jet printer, the tip of the ink supply needle 61 disposed on the ink-jet printer side is passed through the through-hole 108*a* of the rubber packing 108 fitted into the ink outlet 7 of the ink tank 1, whereby the valve 110 positioned inside the ink passage 107 is pushed up. Consequently, the ink absorbed and held by the foam 106 in the foam containing portion 105 of the ink tank 100 is caused to flow into the ink passage 126 via the first filter 111 and the ink chamber 127 as the ink outlet 107 is kept open and then passed through the ink supply needle 61, so that the ink can be supplied to the ink-jet head on the ink-jet printer side. This step is the same as what is taken in the first embodiment of the invention (see FIG. 4(*b*)).

When ink is discharged after the ink-jet head is driven, the ink suction force acts on the ink outlet 107 due to the ink discharge pressure, so that ink is supplied toward the ink-jet head. When the ink held by the foam 106 decreases after ink is thus supplied, air is introduced into the foam containing portion 105 via the ports 113 communicating with the atmosphere. As shown by a chain line in FIG. 10, the ink contained in the foam 106 gradually decreases as the consumption of ink increases and bubbles come into the foam 106. Then the bubbles pass through the first filter 111 and enter the ink chamber 127 as the remaining amount of ink in the foam 106 decreases. In this case, since the second filter 112 that separates the ink chamber 127 from the ink outlet 107 is normally kept in wet condition due to capillary action, no bubbles are allowed to pass through the second filter. Accordingly, bubbles are gradually gathered in the ink chamber 127.

When the remaining amount of ink decreases further, the liquid level of ink stored in the foam containing portion 105 and the ink chamber 127 gradually lowers and the pair of reflective surfaces 131 and 132 are gradually exposed from the liquid level of ink. Consequently, the pair of the reflective surfaces 131 and 132 start functioning as reflective surfaces. When the liquid level of ink in the ink chamber 127 falls below a predetermined liquid level position (e.g., a position L in FIG. 10), the amount of light received by the light receiving element 142 of the optical sensor 140 exceeds a predetermined amount of light to be received thereby. Detection of whether ink in the ink tank 100 is running out (ink end) is based on an increase in the amount of light received by the light receiving element 142.

In a case where the capacity of the ink chamber 30 is set sufficiently small, as the ink end is detected at a point of time when the remaining amount of ink is running short, the ink end is made detectable from a condition in which the remaining amount of ink is reduced to the smallest possible degree, whereby ink is prevented from being wasted.

Even in this embodiment of the invention, the near end condition is assumed then and an amount of ink to be used thereafter is calculated so that the real end is decided when the calculated value reaches an amount equivalent to the capacity of the ink chamber. Thus, ink is usable until the time when the remaining amount of ink is substantially reduced to zero.

According to this embodiment of the invention, as the ink-end detecting structure has been made compact by projecting the ink passage 126 led to the ink outlet 107 inside the ink chamber 127, the advantage is that an increase in the installation space of the ink tank is restrained.

Further, as the absorption material portion 11*b* for sucking up the ink gathered in a position lower than that of the filter 112 in the ink chamber 127 is formed for the second filter 112, the advantage is that the ink gathered in the ink chamber 127 is efficiently consumed.

Further, the remaining ink left in the base portion of the ink chamber is made reducible further by forming the base portion at a level lower than the frame base portion 24*a* as long as only the lower end periphery of the cup-like cap 31 is concerned.

The absorption material portion for sucking up ink may be formed on the first filter 111 instead of the second filter 112. Moreover, the absorption material portion may be disposed as a separate member in the ink chamber 127.

Although it has been arranged that this embodiment of the invention includes the second filter 112, the provision of the second filter 112 may be omitted in a case where the ink tank is disposed in a position lower than that of the ink-jet head or the meniscus of the first filter 11 is restored by a very small amount of ink even though bubbles enter the ink chamber 127.

According to this embodiment of the invention, the ink tank 100 is provided with the pair of prism reflective surfaces 131 and 132 and arranged so as to optically detect the ink end. However, detection of an ink end in an ink tank may be based on variation in impedance between a pair of opposed electrodes instead of optically detecting the ink end. In this case, the electrodes may be disposed in the ink chamber 27 instead of forming the prism reflective surfaces.

As set forth above, according to the invention, the small-capacity ink chamber is formed between the foam containing portion and the ink outlet whereby to make bubbles introducible into the ink chamber from the side of the foam containing portion. Moreover, bubbles are prevented from flowing out of the ink chamber toward the side of the ink outlet and the ink end in the ink tank is detected according to the remaining amount of the ink chamber.

Therefore, according to the invention, the ink end can be detected highly precisely in comparison with a case where the ink end in the ink tank is detected by counting the number of ink discharges from the ink tank and calculating the sucked amount of ink by the ink pump. Thus, the remaining amount of ink in the ink tank at the time of detecting the ink end can be lowered with the effect of suppressing waste of ink.

According to the invention, moreover, as the ink-end detecting structure is formed by forming the projected portion in the inside of the ink chamber and also forming the ink passage led to the ink outlet therein, the advantage is that the ink-end detecting mechanism is formable without increasing the outer dimensions of the ink tank.

The invention includes a gap for sucking up the ink gathered in the base portion of the ink chamber up to the position of the second filter positioned upward, or an ink absorbing material for sucking up the ink is formed. Thus, the remaining ink in the ink chamber is reducible and the utilization efficiency of ink is improved, whereby the quantity of wasted ink is greatly lowered.

What is claimed is:

1. An ink tank comprising:

a foam for absorbing and holding ink;

a foam containing chamber for containing the foam;

a vent port communicating with the foam containing chamber, the vent port allowing atmospheric air to enter the foam containing chamber;

an ink outlet for taking out ink from the foam containing chamber; and an ink detecting chamber for detecting a remaining amount of ink, the ink detecting chamber being disposed between the foam containing chamber and the ink outlet, the ink detecting chamber comprising structure operable to receive ink and bubbles from the foam containing chamber and supply only the ink to the ink outlet while preventing the bubbles from entering to the ink outlet.

2. An ink tank as claimed in claim 1, further comprising a projected portion projecting from a bottom wall of the ink detecting chamber; and a communicating port formed at a front end of the projected portion, the communicating port communicating with the ink outlet.

3. An ink tank as claimed in claim 2, further comprising;

a first filter dividing the foam containing chamber and the ink detecting chamber, the first filter formed of a first porous material which allows bubbles in the foam containing chamber to pass therethrough by ink suction force acting on the ink outlet and, a second filter provided on the communicating port, the second filter formed of a second porous material having a pore diameter smaller than a pore diameter of the first porous material.

4. An ink tank as claimed in claim 3, wherein the second filter has an absorbing material portion for sucking up ink, the absorbing material portion being extended to the bottom wall of the ink detecting chamber.

5. An ink tank as claimed in claim 3, further comprising an absorbing material for sucking up ink, the absorbing material being extended from the communicating port to the bottom wall of the ink detecting chamber.

6. An ink tank as claimed in claim 3, further comprising a prism provided on one of walls of the ink chamber, wherein the prism reflects light received at the prism when the ink fails to contact the prism, and refracts the light into the ink chamber when the ink contacts the prism.

7. An ink tank as claimed in claim 6, wherein the prism has two interface surfaces, each disposed facing at an oblique angle to one another, and each extending from the vicinity of a bottom wall of the ink detecting chamber to the vicinity of an upper wall of the ink detecting chamber.

8. An ink tank as claimed in claim 2, further comprising;

a valve body capable of closing the ink outlet and, a spring member for pressing the valve body against the ink outlet, wherein the valve body and the spring member are disposed between the communicating port and the ink outlet.

9. An ink tank comprising:

a foam for absorbing and holding ink;

a foam containing chamber for containing the foam;

a vent port communicating with the foam containing chamber, the vent port allowing atmospheric air to enter the foam containing chamber;

an ink outlet for taking out ink from the foam containing chamber;

an ink detecting chamber for detecting a remaining amount of ink, the ink detecting chamber being disposed between the foam containing chamber and the ink outlet, the ink detecting chamber operable to receive ink and bubbles from the foam containing chamber and supply only the ink to the ink outlet while preventing the bubbles from entering to the ink outlet;

a projected portion projecting from a bottom wall of the ink detecting chamber;

a communicating port formed at a front end of the projected portion, the communicating port communicating with the ink outlet; and a cap member for covering the projected portion, wherein a gap for sucking up ink is formed between the projected portion and the cap member, the gap being extended from the communicating port to the bottom wall of the ink detecting chamber.

10. An ink tank as claimed in claim 9, further comprising a first filter dividing the foam containing chamber and the ink detecting chamber, the first filter formed of a first porous material which allows bubbles in the foam containing chamber to pass therethrough by ink suction force acting on the ink outlet; and a second filter provided on the communicating port, the second filter formed of a second porous material having a pore diameter smaller than a pore diameter of the first porous material.

11. An ink tank as claimed in claim 9, wherein a projection for use in forming the gap for sucking up ink is formed on an outer face of the projected portion and/or an inner face of the cap member.

12. An ink tank as claimed in claim 11, herein the projection is a projection operable to position the cap member.

13. An ink tank as claimed in claim 11, wherein the cap member is such that a communicating section which communicates with the gap for sucking up ink is formed between an open edge face of the cap and the bottom wall of the ink detecting chamber facing the open edge face thereof.

14. An ink tank as claimed in claim 13, wherein the open edge face of the cap has a plurality of projections for use in forming the communicating portion.

15. An ink tank as claimed in claim 9, further comprising a prism provided on one of walls of the ink detecting chamber, wherein the prism reflects light received at the prism when the ink fails to contact the prism, and refracts the light into the ink detecting chamber when the ink contacts the prism.

16. An ink tank as claimed in claim 15, wherein the reflective surfaces of the prism are longer than they are wide in a depth direction of the ink detecting chamber.

17. An ink-jet printer comprising:

an ink-jet head for ejecting ink drops, an ink tank for containing ink to be supplied to the ink-jet head, the ink tank further comprising:

a foam for absorbing and holding ink;

a foam containing chamber for containing the foam;

a vent port communicating with the foam containing chamber, the vent port allowing atmospheric air to enter the foam containing chamber;

an ink outlet for taking out ink from the foam containing chamber;

an ink detecting chamber for detecting a remaining amount of ink, the ink detecting chamber being disposed between the foam containing chamber and the ink outlet, the ink detecting chamber comprising structure operable to receive ink and bubbles from the foam containing chamber and supply only the ink to the ink outlet while preventing the bubbles from entering to the ink outlet;

a prism having two interface surfaces provided on one of walls of the ink detecting chamber, wherein the prism reflects light received at the prism when the ink fails to contact the prism, and refracts the light into the ink detecting chamber when the ink contacts the prism, and an ink-end detecting mechanism having a light emitting element and a light receiving element capable of receiving light emitted from the light emitting element and also reflected from the two interface surfaces, wherein a presence or absence of ink in the ink tank is detected according to a remaining amount of ink in the ink detecting chamber by the amount of light reflected from the prism.

18. An ink-jet printer as claimed in claim 17, wherein the ink tank includes:

a projected portion projecting from a bottom wall of the ink detecting chamber;

a communicating port formed at a front end of the projected portion, the communicating port communicating with the ink outlet; and a cap member for covering the projected portion, wherein a gap for sucking up ink is formed between the projected portion and the cap member, the gap being extended from the communicating port to the bottom wall of the ink detecting chamber.

* * * * *